US007491118B2

(12) United States Patent
Yun et al.

(10) Patent No.: US 7,491,118 B2
(45) Date of Patent: Feb. 17, 2009

(54) CHEMICAL MECHANICAL POLISHING APPARATUS AND METHODS USING A POLISHING SURFACE WITH NON-UNIFORM RIGIDITY

(75) Inventors: Hyun Joo Yun, Kyunggi-Do (KR); Young Sam Lim, Seoul (KR); Jae Pil Boo, Sungnam-Si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 11/427,360

(22) Filed: Jun. 29, 2006

(65) Prior Publication Data

US 2006/0240749 A1 Oct. 26, 2006

Related U.S. Application Data

(63) Continuation of application No. 10/830,396, filed on Apr. 22, 2004, now Pat. No. 7,090,570.

(30) Foreign Application Priority Data

Nov. 4, 2003 (KR) ..... 10-2003-77637

(51) Int. Cl.
*B24B 1/00* (2006.01)

(52) U.S. Cl. ..... 451/289; 451/528

(58) Field of Classification Search ..... 451/5, 451/6, 8, 41, 285–290
See application file for complete search history.

(56) References Cited

U.S. PATENT DOCUMENTS 5,435,772 A * 7/1995 Yu ..... 451/63
5,643,061 A * 7/1997 Jackson et al. ..... 451/289
5,769,699 A * 6/1998 Yu ..... 451/528
5,899,745 A * 5/1999 Kim et al. ..... 438/692
5,964,643 A 10/1999 Birang et al.
5,985,090 A * 11/1999 Kikuta et al. ..... 156/345.12
6,093,085 A * 7/2000 Yellitz et al. ..... 451/41
6,135,856 A * 10/2000 Tjaden et al. ..... 451/37
6,220,942 B1 * 4/2001 Tolles et al. ..... 451/65
6,331,137 B1 12/2001 Raeder et al.
6,340,325 B1 * 1/2002 Chen et al. ..... 451/56
6,454,630 B1 * 9/2002 Tolles ..... 451/6
6,524,164 B1 * 2/2003 Tolles ..... 451/6
6,537,133 B1 3/2003 Johansson et al.
6,544,107 B2 * 4/2003 Misra et al. ..... 451/41
6,561,873 B2 5/2003 Tsai et al.
6,585,579 B2 7/2003 Jensen et al.
6,634,936 B2 10/2003 Jensen et al.
6,857,941 B2 * 2/2005 Emami et al. ..... 451/41
7,014,538 B2 * 3/2006 Tietz et al. ..... 451/56

(Continued)

*Primary Examiner*—Maurina Rachuba
(74) *Attorney, Agent, or Firm*—Myers Bigel Sibley & Sajovec, PA

(57) ABSTRACT

A chemical mechanical polishing apparatus includes a platen, a polishing pad affixed to a surface of the platen, and a polishing head configured to retain and rotate a wafer while pressing a surface of the rotating wafer against the polishing pad. A first portion of the polishing pad that engages the polishing head proximate the edge of the wafer provides less rigidity than a second portion of the polishing pad that engages a portion of the surface of the wafer. For example, the polishing pad and/or the platen may have a recess or other cushioning structure positioned proximate a locus of movement of a portion of the polishing head that supports the edge of the wafer.

4 Claims, 14 Drawing Sheets

U.S. PATENT DOCUMENTS 7,090,570 B2 * 8/2006 Yun et al. ..... 451/287
2001/0031612 A1 * 10/2001 Scott et al. ..... 451/65
2003/0224703 A1 * 12/2003 Moloney et al. ..... 451/36

* cited by examiner

CHEMICAL MECHANICAL POLISHING APPARATUS AND METHODS USING A POLISHING SURFACE WITH NON-UNIFORM RIGIDITY

CLAIM FOR PRIORITY AND RELATED APPLICATION

This application claims priority to and is a continuation of parent application Ser. No. 10/830,396, filed Apr. 22, 2004 now U.S. Pat. No. 7,090,570, the disclosure of which is hereby incorporated herein by reference, and is related to Korean Patent Application No. 10-2003-77637 filed Nov. 4, 2003, the contents of which are herein incorporated by reference in their entirety.

BACKGROUND OF THE INVENTION

The present invention relates to apparatus and methods for fabricating microelectronic devices, and more particularly, to polishing apparatus and methods.

Fabrication of integrated circuit devices, such as memory devices, microprocessors, and the like, commonly involves the use of chemical mechanical polishing (CMP) to remove materials from a wafer surface and/or to planarize the surface of the wafer before building up additional structures. Generally, CMP involves rubbing the surface of the wafer against a pad made of a resilient material, such as polyurethane, in the presence of a chemical slurry to remove material, such as a metallization layer, deposited on the wafer surface. The pad and/or the slurry may include abrasives.

Several different types of CMP machines have been developed One type of machine uses a disk-shaped polishing pad that is affixed to a fixed or rotating platen. In such a machine, the wafer is typically supported by a polishing head that rotates the wafer and presses the rotating wafer's surface against the polishing pad.

An example of such a disk-type polishing machine is shown in FIG. 1. The polishing machine 100 includes a polishing head 110, a platen 120, a polishing pad 130 affixed to the platen 120, and a pad conditioner 140. The platen 120 is driven by a motor 150 via a shaft 160. The polishing head 110 is driven by a motor 170 via a shaft 150. The polishing head 110 and the platen 120 may rotate in the same direction or in opposite directions.

FIG. 2 is a cross sectional view of the polishing head 10. The polishing head 110 includes a carrier 111, a manifold 112, a support 113, a retaining ring 114, and a membrane 115. The support 113 includes an inner support 113*b* and an outer support 113*a*. The outer support 113*a* has a generally cylindrical shape with a ring-shaped wall 116 and a protrusion 117. A first fluid path 118 and a second fluid path 119 are configured to carry de-ionized water used to clean the head 110, and to carry air to provide vacuum to pick up wafers and pressure for the polishing process. In particular, the first fluid path 115 and the second fluid path 119 provide pressure at the center area of the wafer and at the edge area of the wafer, respectively, during polishing. First and second holes 121, 122 communicate with the membrane 115. The retaining ring 114 prevents the wafer from slipping out of the polishing head 110.

FIG. 3 shows a typical operation of the polishing machine 100. While holding and rotating a wafer W, the polishing head 110 presses the wafer W against the rotating polishing pad 130. As shown, the polishing head 110 and platen 120 both rotate clockwise. The polishing head 10 may also oscillate in a horizontal plane while holding the wafer against the pad 130, as shown by the double-headed arrow.

A polishing pad may have surface features, such as grooves, that can aid distribution of slurry across the surface of the wafer, as shown in, for example, U.S. Pat. No. 6,561,873 to Tsai et al. Some types of CMP machines impress a spinning wafer against a belt-type polishing pad, as shown, for example, in U.S. Pat. No. 6,634,936 to Jensen et al. and U.S. Pat. No. 6,585,579 to Jensen et al.

Because of the nature of the polishing process, CMP pads wear as they are used. It is generally desirable that wear occur in a uniform manner over the part of the pad that contacts the wafer, such that a substantially uniform polishing profile can be maintained as wafers are polished in the fabrication process. For example, a pad design that tears or develops a significantly non-uniform surface may provide unacceptably non-uniform polishing results or may need to be replaced more often than desired.

SUMMARY OF THE INVENTION

According to some embodiments of the present invention, a chemical mechanical polishing apparatus includes a platen, a polishing pad affixed to a surface of the platen, and a polishing head configured to retain and rotate a wafer while pressing a surface of the rotating wafer against the polishing pad. A first portion of the polishing pad that engages the polishing head proximate the edge of the wafer provides less rigidity than a second portion of the polishing pad that engages a portion of the surface of the wafer. For example, the platen and the polishing head may interoperate such that the rotating wafer moves in a loop across a surface of the pad, and the first portion of the polishing pad may engage the polishing head proximate an innermost portion of the loop.

In some embodiments of the present invention, the polishing pad and/or the platen has a recess therein positioned proximate a locus of movement of a portion of the polishing head that supports the edge of the wafer. The platen and the polishing head may interoperate to move the rotating wafer in a loop across a surface of the pad, and the recess may be proximate an innermost portion of the loop. For example, the polishing head may include a retaining ring that retains the edge of the wafer and that extends flush with the surface of the wafer to be polished, and the recess may have an edge that underlies the retaining ring.

According to further embodiments of the present invention, the polishing pad and the platen interoperate to provide a cushion where the polishing pad engages the polishing head proximate the edge of the wafer. The cushion may include an airspace bounded by the pad and/or the platen. For example, the airspace may include a recess in the pad and/or a recess in the platen.

In certain embodiments of the present invention, a chemical mechanical polishing apparatus includes a platen, a polishing head configured to retain and rotate a wafer while forcing a surface of the rotating wafer towards the surface of the platen, and a pad affixed to the surface of the platen, configured to engage the surface of the rotating wafer, and having a recess in a surface thereof that opens toward the surface of the platen and that is disposed proximate a locus of movement of an edge of the wafer across the pad. The recess may be proximate a locus of movement of a portion of the polishing head that supports the edge of the wafer, e.g., a retaining ring of the polishing head.

In certain embodiments, the recess includes a single recess centered at a center of the loop. In some embodiments, the recess includes a groove concentric with the loop. In further embodiments, the pad includes a resilient layer, the recess includes a recess in the resilient layer, and the pad further includes a material less rigid than the resilient layer in the recess. In additional embodiments, the pad includes a first resilient layer having the recess therein, and a second resilient layer interposed between the first resilient layer and the surface of the platen and less rigid than the first resilient layer. The pad may further include a material less rigid than the first resilient layer in the recess. The second resilient layer may have an opening therethrough between the recess of the first resilient layer and the surface of the platen, and the pad may include a material less rigid than the first resilient layer in the recess in the first resilient layer and the opening through the second resilient layer.

According to further aspects of the present invention, the pad includes a transparent material, and the platen bears a registration mark on the surface thereof that is visible through the pad. The pad may bear a registration mark corresponding to the registration mark on the platen.

In still further embodiments of the present invention, a chemical mechanical polishing apparatus includes a platen having a surface configured to receive a polishing pad thereon and a polishing head configured to retain and rotate a wafer while forcing a surface of the rotating wafer of the wafer towards the surface of the platen. The platen surface has a recess therein proximate a locus of movement of an edge of the wafer across the platen. The polishing head and platen may interoperate to move the rotating wafer in a loop across the surface of the platen, and the recess in the platen may be proximate an innermost portion of the loop.

In additional embodiments of the present invention, a polishing pad is provided for a chemical mechanical polishing apparatus that includes a platen having a surface configured to receive a polishing pad thereon and a polishing head configured to retain and rotate a wafer while pressing a surface of the rotating wafer against the polishing pad. The polishing pad includes a resilient layer configured to be affixed to the surface of the platen and to engage the rotating wafer, wherein the resilient layer, when affixed to the platen, has a first portion that engages the polishing head proximate the edge of the wafer and that provides less rigidity than a second portion of the resilient layer that engages a portion of the surface of the wafer. The resilient layer may be configured to contact a retaining ring that retains the edge of the wafer and that extends flush with the surface of the wafer to be polished, and the first portion of the resilient layer may configured to be positioned proximate a locus of movement of the retaining ring across the resilient layer. The resilient layer may have a recess in a surface thereof configured to be positioned toward the surface of the platen proximate a locus of movement of the edge of the wafer across the resilient layer. The resilient layer may be configured to provide a cushion where the pad engages the polishing head proximate the edge of the wafer.

According to some method embodiments of the present invention, a chemical mechanical polishing method includes pressing a surface of a rotating wafer on to a polishing pad and providing less rigidity in the pad where the pad engages the polishing head proximate an edge of the wafer than where the pad engages a portion of the surface of the wafer. The method may further include moving the rotating wafer in a loop across a surface of the pad, and providing less rigidity in the pad where the pad engages the polishing head proximate the edge of the wafer may include providing less rigidity proximate an innermost portion of the loop. For example, providing less rigidity in the pad where the pad engages the polishing head proximate an edge of the wafer may include providing a recess in the polishing pad and/or the platen proximate a locus of movement of the edge of the wafer across the polishing pad.

BRIEF DESCRIPTION OF THE DRAWINGS

FIG, 11 is a side view of a polishing apparatus utilizing the polishing pad of FIGS. 4 and 5 according to some embodiments of the present invention.

DETAILED DESCRIPTION OF EXEMPLARY EMBODIMENTS

Figure 1:
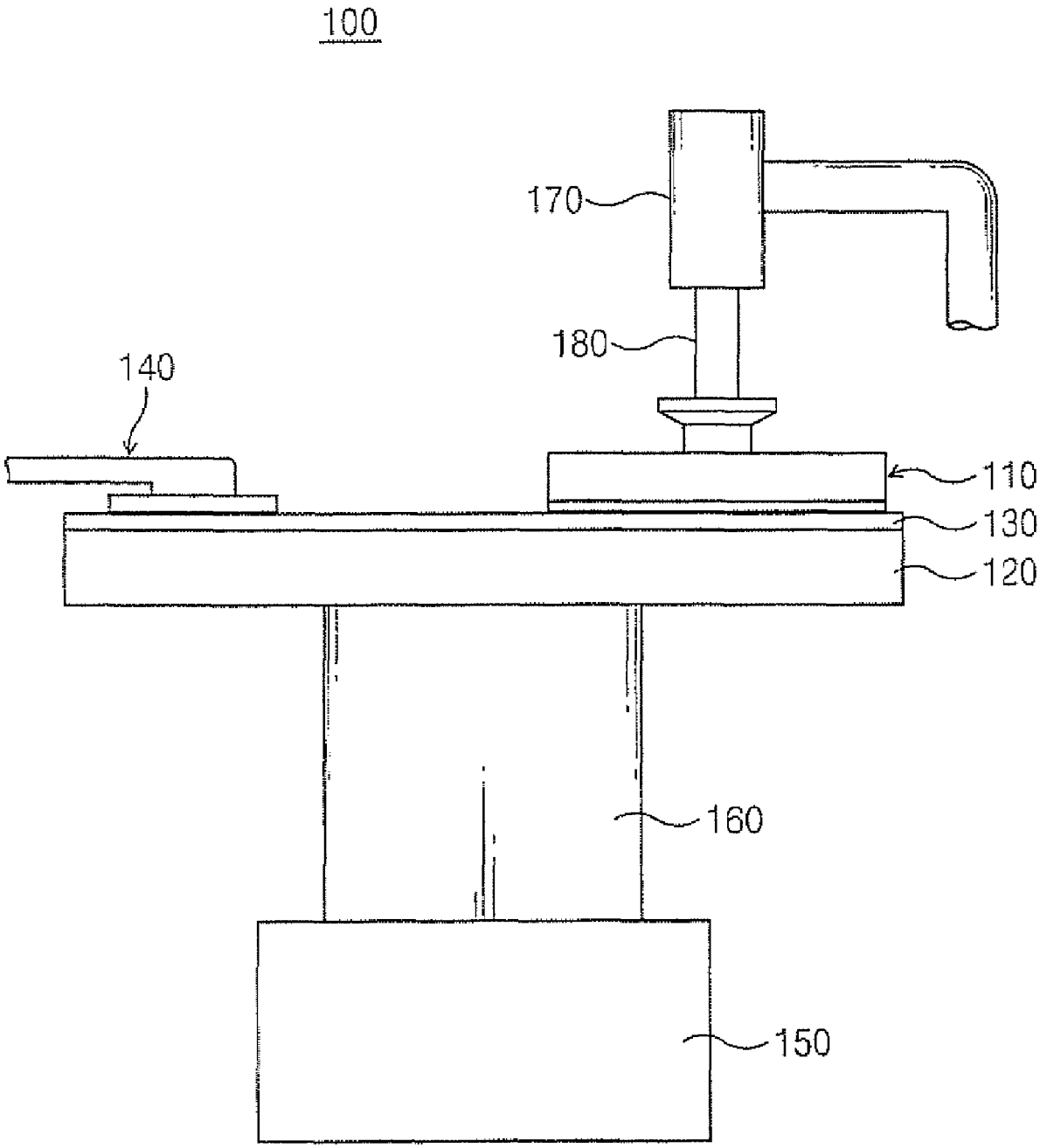
Fig. 1 (Prior Art)
FIG. 1 is a side view of a conventional polishing machine.
Figure 2:
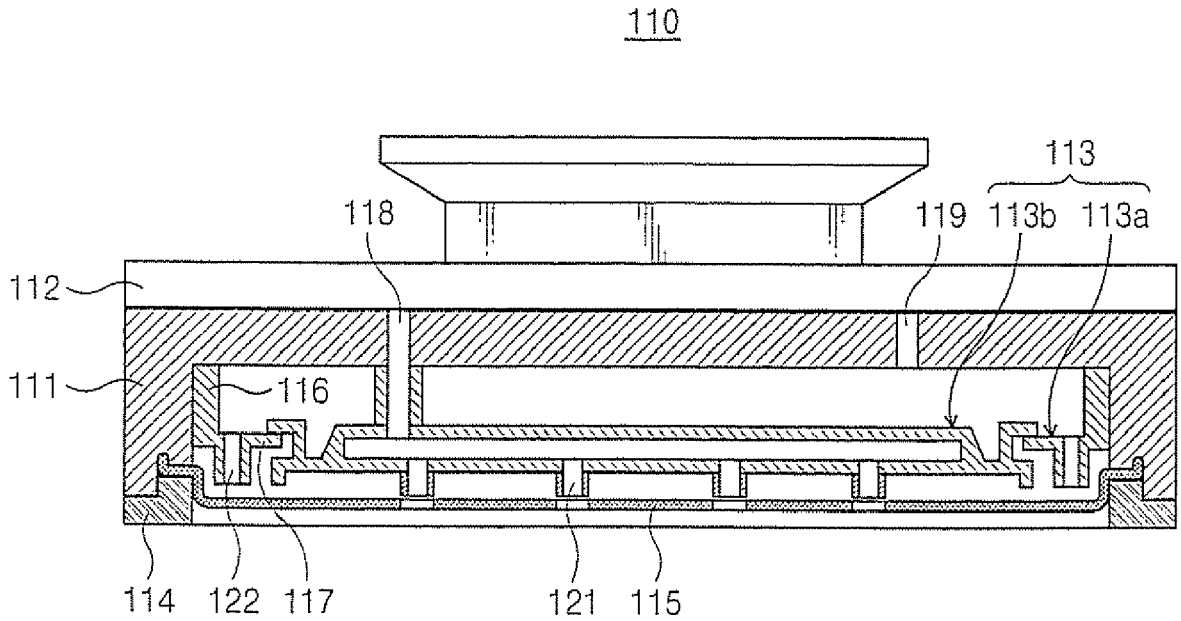
Fig. 2 (Prior Art)
FIG. 2 is a cutaway view of a polishing head of the polishing machine of FIG, 1.
Figure 3:
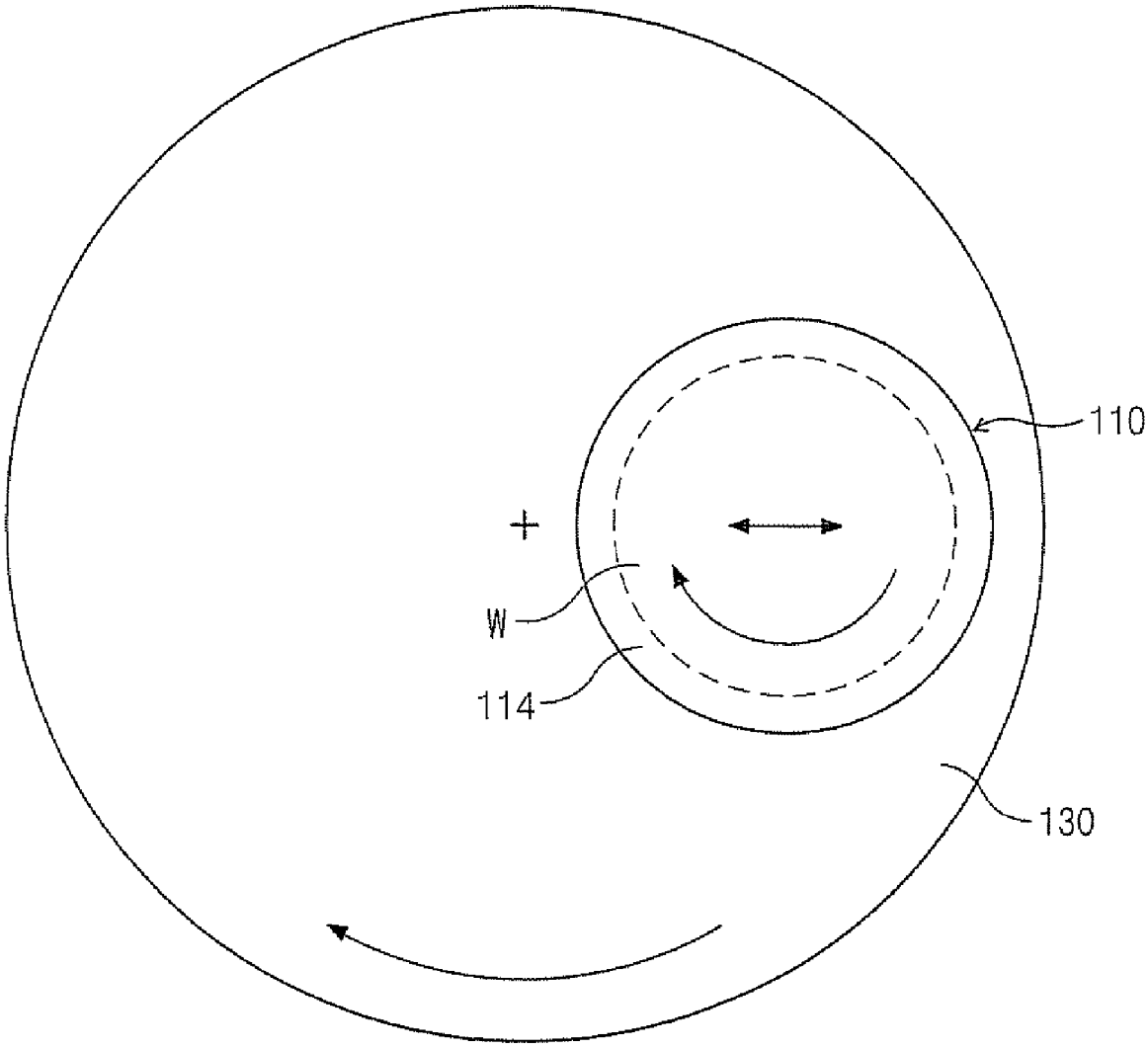
Fig. 3 (Prior Art)
FIG. 3 is a top view illustrating operations of the polishing machine of FIG. 1.

The present invention now will be described more filly hereinafter with reference to the accompanying drawings, in which typical and exemplary embodiments of the invention are shown. This invention may, however, be embodied in many different forms and should not be construed as limited to the embodiments set forth herein. Rather, these embodiments are provided so that this disclosure will be thorough and complete, and will filly convey the scope of the invention to those skilled in the art.

In the drawings, the thickness of layers and regions are exaggerated for clarity. It will be understood that when an element such as a layer or region is referred to as being "on" another element, it can be directly on the other element or intervening elements may also be present. Furthermore, relative terms, such as "beneath," may be used herein to describe one element's relationship to another elements as illustrated in the drawings. It will be understood that relative terms are intended to encompass different orientations of a structure in addition to the orientation depicted in the drawings. For example, if the structure in the drawings is turned over, elements described as "below" other elements would then be oriented "above"[1] the other elements. The exemplary term "below," therefore, encompasses both an orientation of above and below.

It will be understood that although the terms "first" and "second" are used herein to describe various regions, layers and/or components, these regions, layers and/or components should not be limited by these terms. These terms are only used to distinguish one region, layer or section from another region, layer or section. Thus, a first region, layer or section discussed below could be termed a second region, layer or section, without departing from the teachings of the present invention. As used herein the term "and/or" includes any and all combinations of one or more of the associated listed items. Like numbers refer to like elements throughout.

Figure 4:
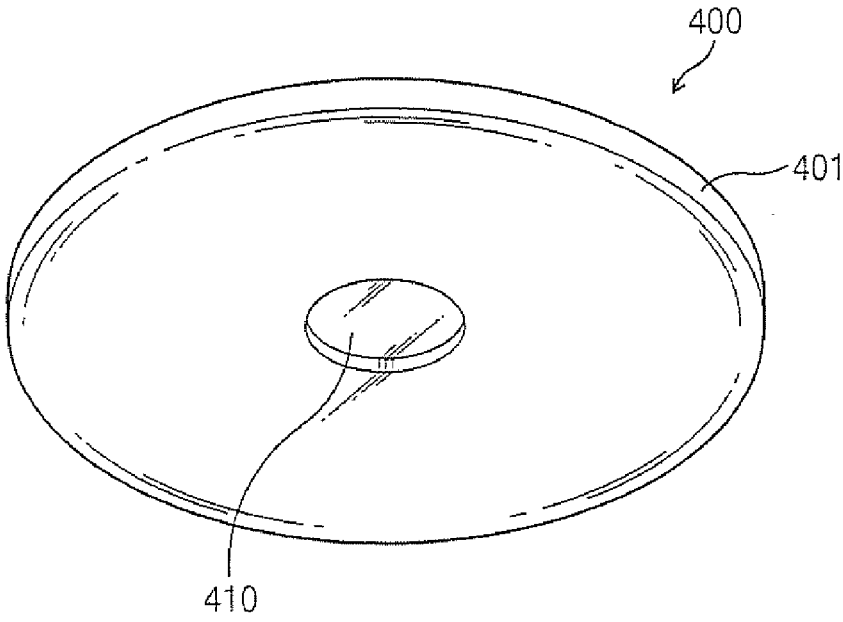
FIG. 4 is a perspective view of a polishing pad according to some embodiments of the present invention.
Figure 5:
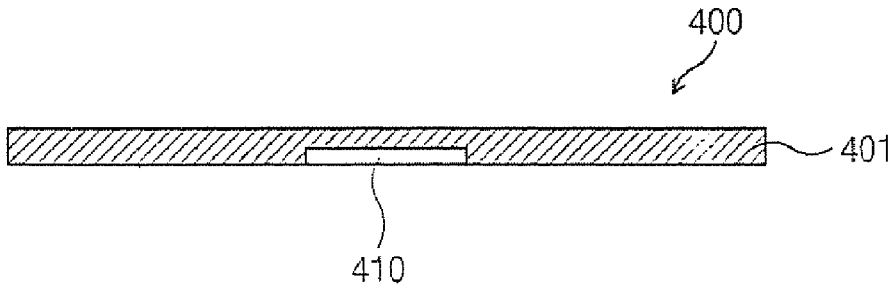
FIG. 5 is a cross-sectional view of the pad of FIG. 4.

FIGS. 4 and 5 illustrate a polishing pad 400 according to some embodiments of the present invention. The pad 400 includes a disk-shaped resilient layer 401 having a recess 410 formed therein about its center. The recess 410 is configured to open towards the surface of the platen of the polishing machine (e.g., the machine in FIG. 1) when the pad 400 is installed, thus forming an air cushion between the pad 400 and the platen. The recess 410 may be formed using any of a variety of different techniques, including cutting or skiving. The pad 400 may include any of a number of different materials, including, but not limited to, any of a variety of materials including polycarbonate, acrylic rubber, acrylic resin, cellulose, polystyrene, thermoplastic polyester, acrylonitrile butadiene styrene (ABS), polyvinyl chloride (PVC), allyl diglycol carbonate (ADC), polyurethane, and/or polybutadiene.

Figure 6:
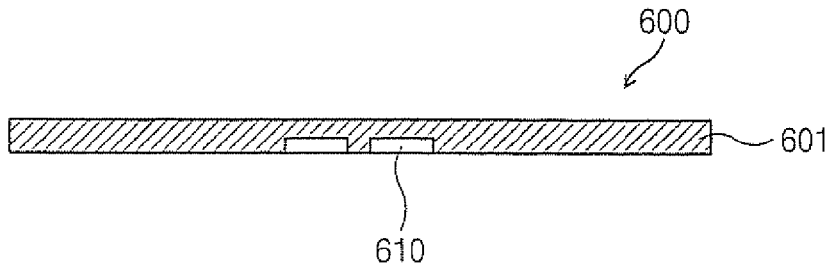
FIGS. 6-10 are cross-sectional views of various polishing pads according to various embodiments of the present invention.
Figure 7:
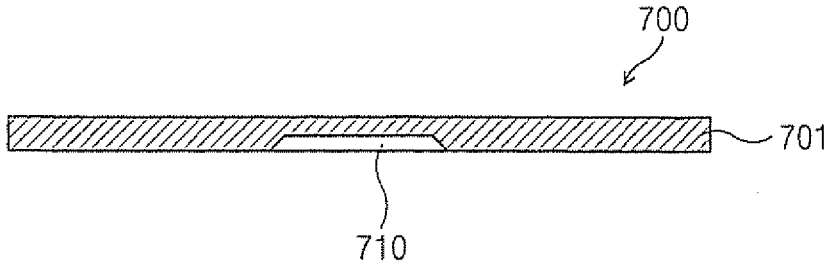

FIGS. 6-10 illustrate a variety of polishing pad configurations according to various embodiments of the present invention. FIG. 6 is a cross-sectional view of a polishing pad 600 according to further embodiments of the present invention, wherein a recess for forming an air cushion under the pad 600 includes a circular groove 610 formed in a disk-shaped resilient layer 601. FIG. 7 is a cross sectional view of a polishing pad 700 according to additional embodiments, which includes a disk-shaped resilient layer with a recess 710 having sloped sidewalls.

Figure 8:
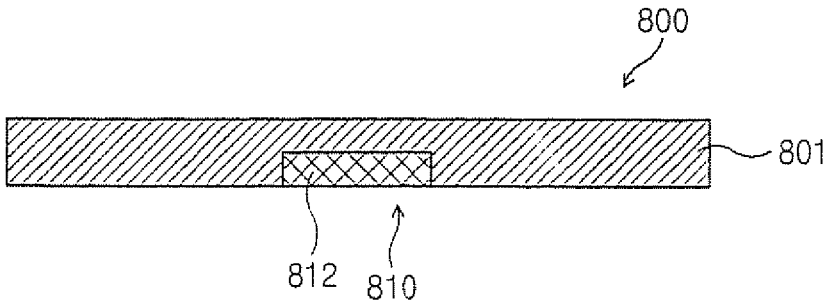

A pad 800 according to other embodiments of the present invention illustrated in FIG. 8 includes disk 801 having a recess 8 10 therein filled with a material 812 that is less rigid than the disk 801. For example, the disk 801 may be formed of polycarbonate, acrylic rubber, acrylic resin, cellulose, polystyrene, thermoplastic polyester, acrylonitrile butadiene styrene (ABS), polyvinyl chloride (PVC), allyl diglycol carbonate (ADC), polyurethane, and/or polybutadiene, and the less rigid material 814 in the recess 812 may be, for example, an open-cell foam or non-woven fiber material.

Figure 9:
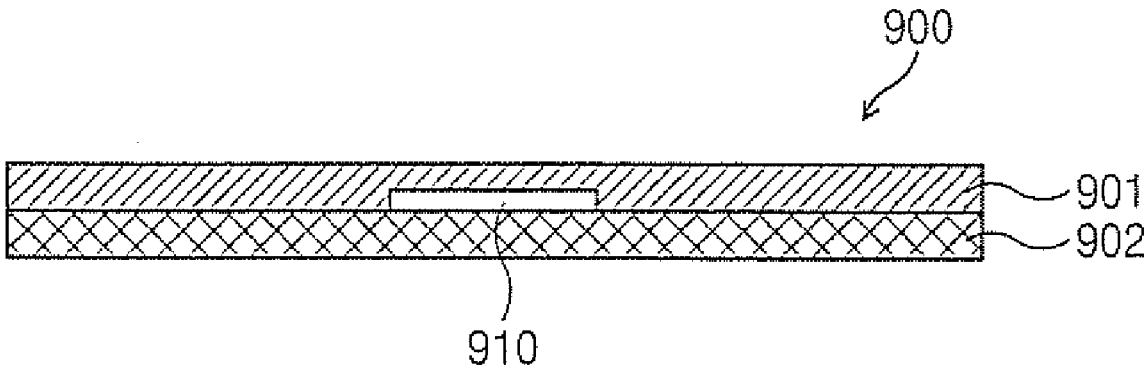
Figure 10:
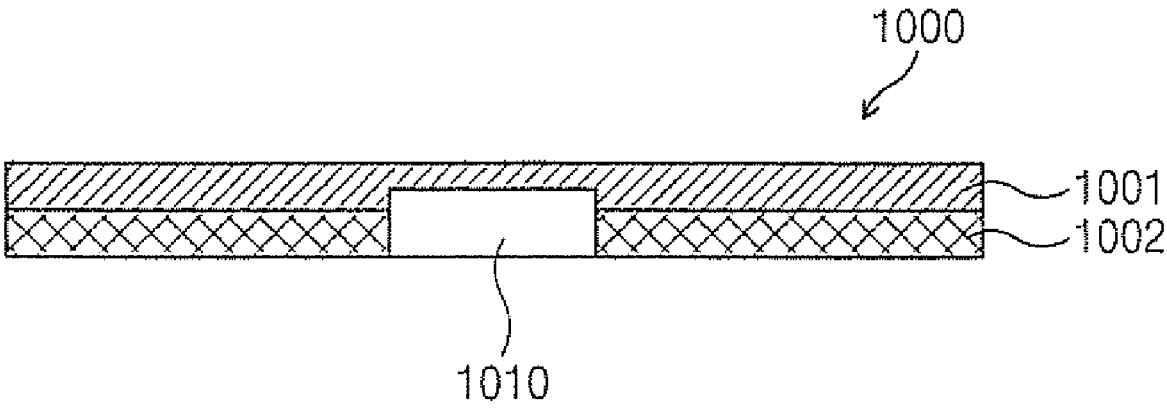

FIG. 9 illustrates a pad 900 including first and second disks 901, 902, wherein the first disk 901 is made of a stiffer material, such as polycarbonate, acrylic rubber, acrylic resin, cellulose, polystyrene, thermoplastic polyester, acrylonitrile butadiene styrene (ABS), polyvinyl chloride (PVC), allyl diglycol carbonate (ADC), polyurethane, and/or polybutadiene, and the second disk 902 is a less rigid material, such as an open-cell foam or a non-woven fiber material. The first disk 901 is adhesively bonded to the second disk 901, and has recess 910 formed therein. FIG. 10 illustrates a pad 100 including rigid and less rigid disks 1001, 1002, respectively, and a recess 1010 that passes through the second disk 1002 and into the first disk 1001.

It will be appreciated that a number of other pad configurations fall within the scope of the present invention, and that the invention is not limited to the configurations illustrated. For example, a reduced-rigidity area in a polishing pad may be provided by other structures that provide a cushion at a selected area of a pad, for example, by embedding air or gas bubbles in selected portions of a resilient layer to provide reduced rigidity and/or by using a less rigid material at a selected area of a pad. The present invention is also applicable to pads having non-disk-like shapes, including, but not limited to, belt-like pads.

Figure 11:
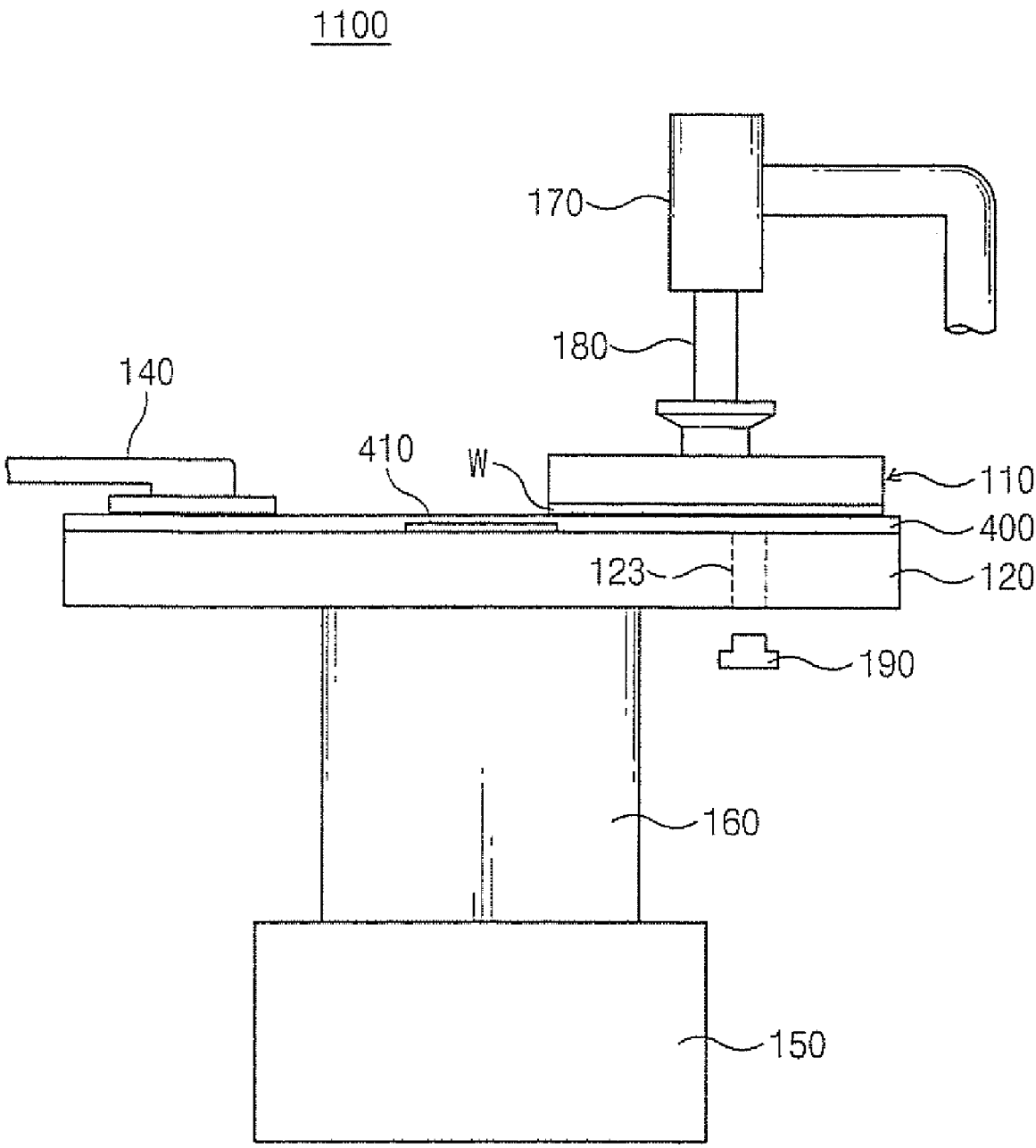

FIG. 11 illustrates a polishing apparatus 1100 according to some embodiments of the present invention, including a pad 400 as illustrated in FIGS. 4 and 5. As shown, the apparatus 1100 includes a platen 120 driven by a motor 150 and shaft 160, a polishing head 110 driven by a motor 170 and a shaft 180, and a pad conditioner 140. The pad 400 is affixed to the platen 120 such that the recess 410 faces the surface of the platen 120. The recess 410 is configured to provide decreased rigidity proximate the edge of the wafer W as the polishing head 110 forces the wafer W against the pad 400. As further shown in FIG. 11, the apparatus 1100 may further include a detector 190, such as the laser interferometer-based detector described in U.S. Pat. No. 5,964,643 to Birang et al., that monitors the polished surface of the wafer W through an opening or window 123 in the platen 120 and through the pad 400 to enable monitoring of the surface condition of the wafer W. Such monitoring may be used, for example, to detect when a desired polishing result has been achieved. It will be appreciated that at least portion of the pad 400 overlying the opening or window 123 preferably is transparent in the spectrum used by the detector 190 to allow for such monitoring.

Figure 12:
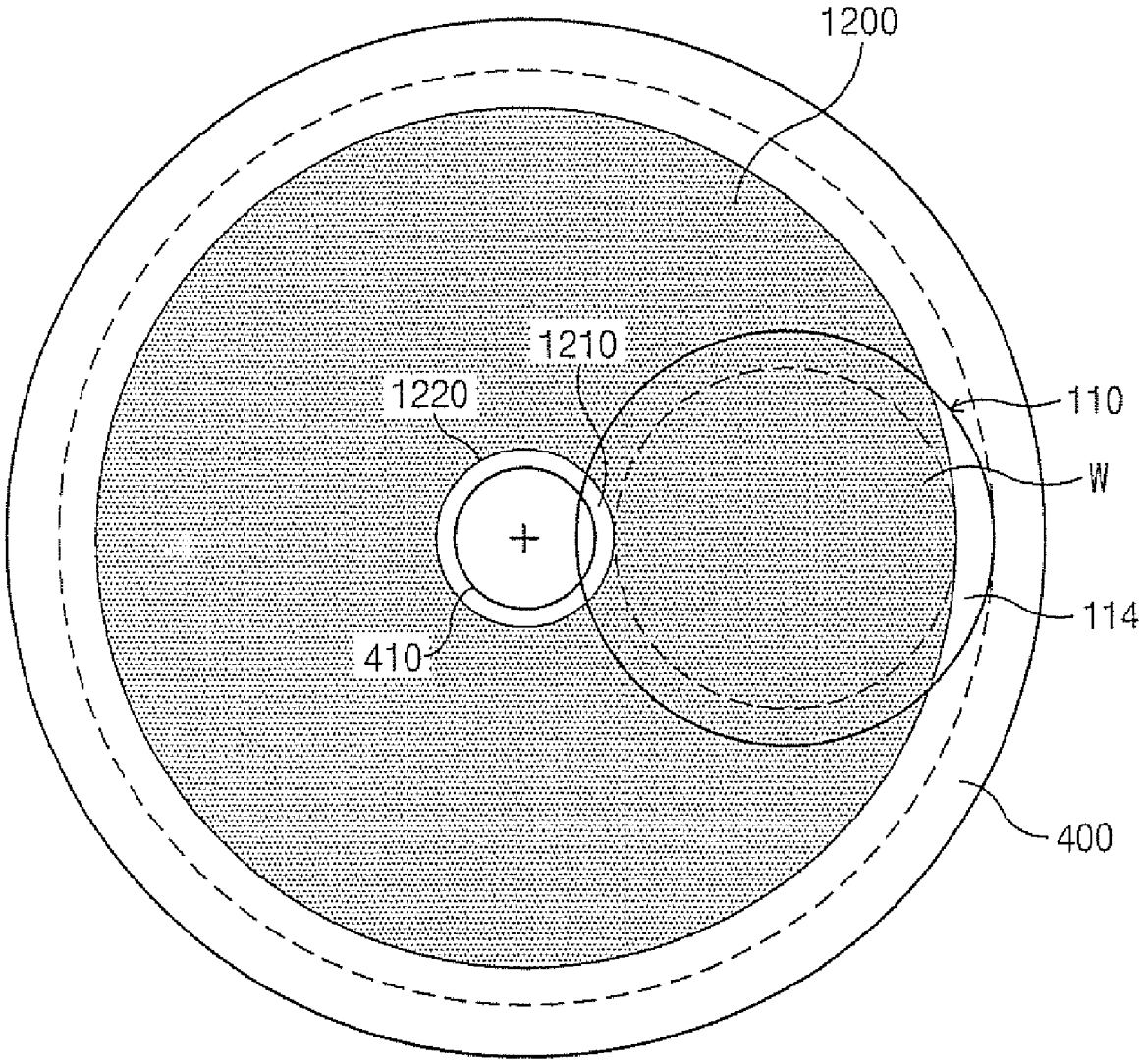
FIG. 12 is a top view illustrating exemplary operations of the polishing apparatus of FIG. 11.
Figure 13:
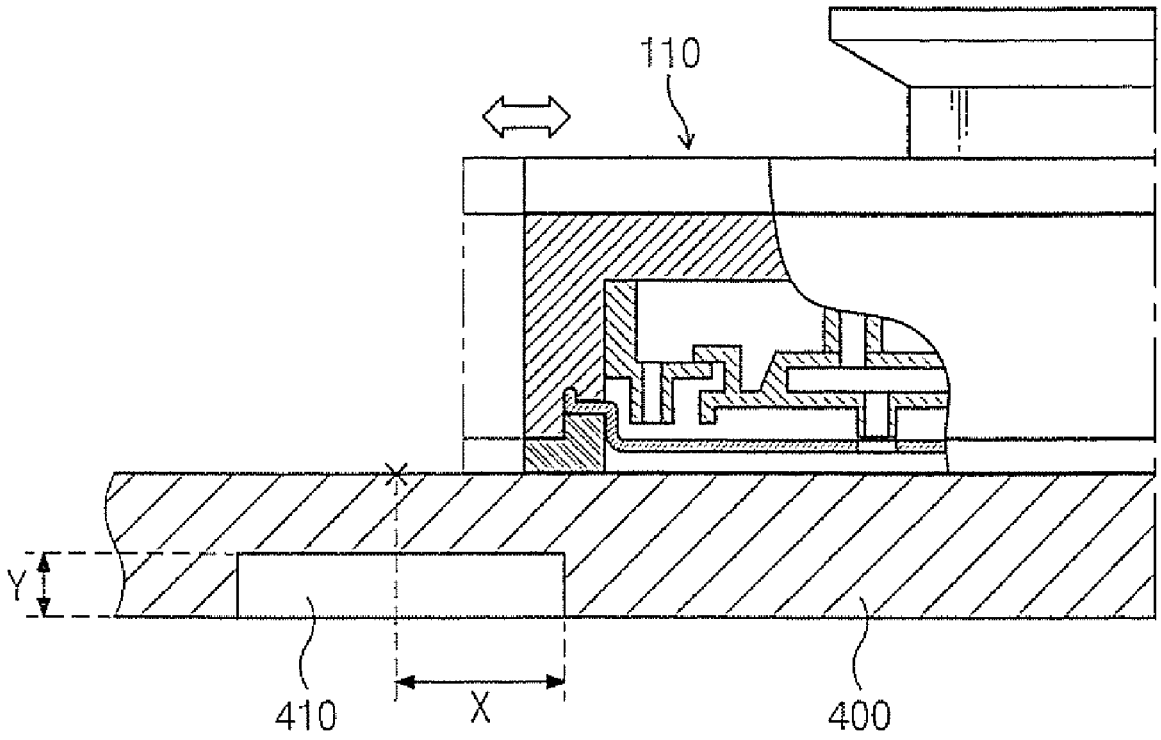
FIG. 13 is a cutaway view illustrating features of the polishing pad of FIG. 11 in relation to the polishing head of the apparatus of FIG. 11.

As shown in FIGS. 12 and 13, when the pad 400 is affixed to the platen 120, the recess 410 is centered around an axis of a circular loop 1200 described by the polishing head 110 as it moves the wafer W across the surface of the pad 400. Preferably, the recess 410 is proximate a locus of movement 1210 of the retaining ring 114 of the polishing head 110, i.e., as the polishing head 110 moves the wafer W around the surface of the pad 400 around the loop 1200, the recess 410 of the pad 400 is proximate an innermost portion 1220 of the loop 1200. It will be appreciated that the size and/or shape of the recess may be altered depending on the nature of the movement of the polishing head (e.g., oscillatory or non-oscillatory movement), the nature of the pad material, and/or the nature of the polishing process (e.g., the type of slurry and/or material being polished). It will be further appreciated that other pad configurations may be used in similar ways to those described above with reference to FIGS. 12 and 13. For example, the pads shown in FIGS. 6-9 may be mounted with their recesses and/or less rigid portions positioned in a manner similar to that described with reference to FIGS. 12 and 13. It will also be understood that the present invention is applicable to other types of machines than the one illustrated in FIGS. 11-13, such as machines that have a polishing head that moves a rotating wafer in a loop around a fixed platen.

Investigations of pad designs have been conducted for an Ebara FREX 3005 polishing machine having a structure along the lines shown in FIG. 11. The machine has a polishing head with an approximately 300 mm diameter retaining ring, with the width of the retaining ring being around 25 mm. As the polishing head oscillates, the centerline of the retaining ring moves between about 30 mm and about 50 mm from the center of the polishing pad. It has been determined that a pad having a circular recess as shown in FIG. 1I1 with a radius of about 15 mm to about 50 mm may be particularly advantageous for such a machine. If the recess is too small, for example, such that it does not reach to under the retaining ring, the pad may erode and/or tear. If the recess is too large, the polishing rate at the edge portion of wafer may be undesirably decreased. For a polybutadiene pad with a thickness of about 2 mm, it has been found that a recess with a depth of about 0.1 mm to about 0.5 mm produces desirable results. It will be appreciated that optimal recess size and/or shape may depend on a number of different factors, including, but not limited to, the type of machine, pad material, slurry properties and wafer properties.

Figure 14:
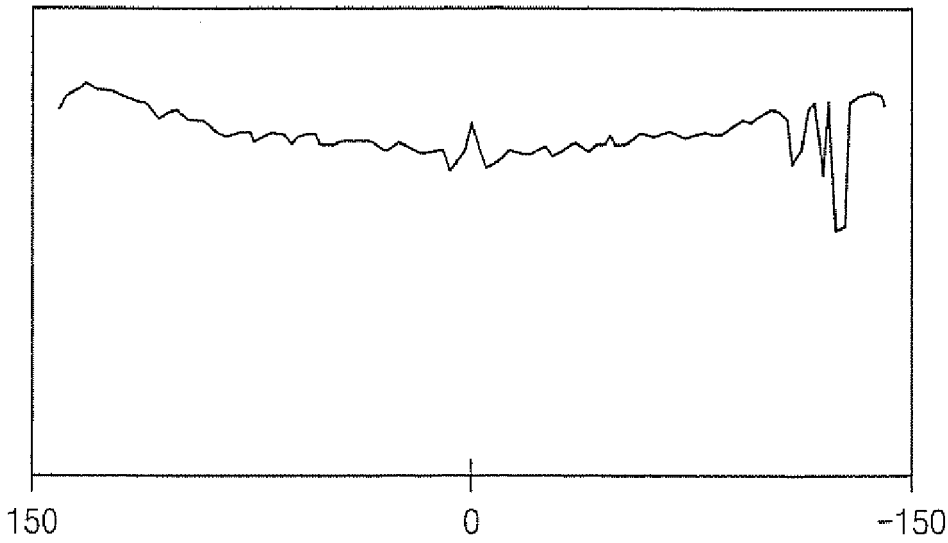
FIG. 14 is a graph illustrating a polishing profile of a conventional polishing apparatus.
Figure 15:
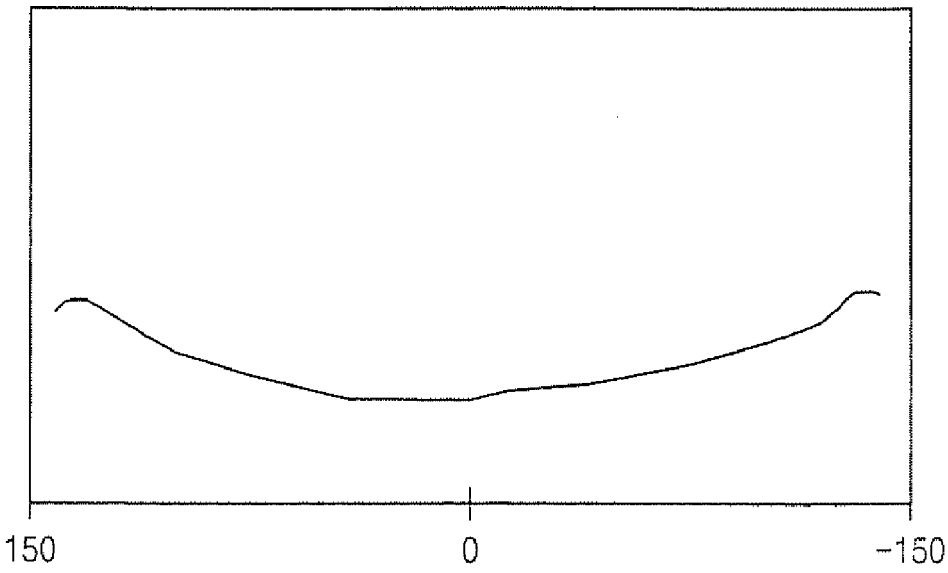
FIG. 15 is a graph illustrating a polishing profile of a polishing apparatus according to some embodiments of the present invention.

FIGS. 14 and 15 show polishing profiles produced using a conventional polishing pad configuration and a pad configuration according to some embodiments of the present invention, respectively. The profile produced using a conventional configuration (FIG. 14) exhibits significant non-uniformity, including a hunting area near the edge of the wafer, while the polishing profile using a polishing pad according to embodiments of the present invention (FIG. 15) exhibits improved uniformity.

Figure 16:
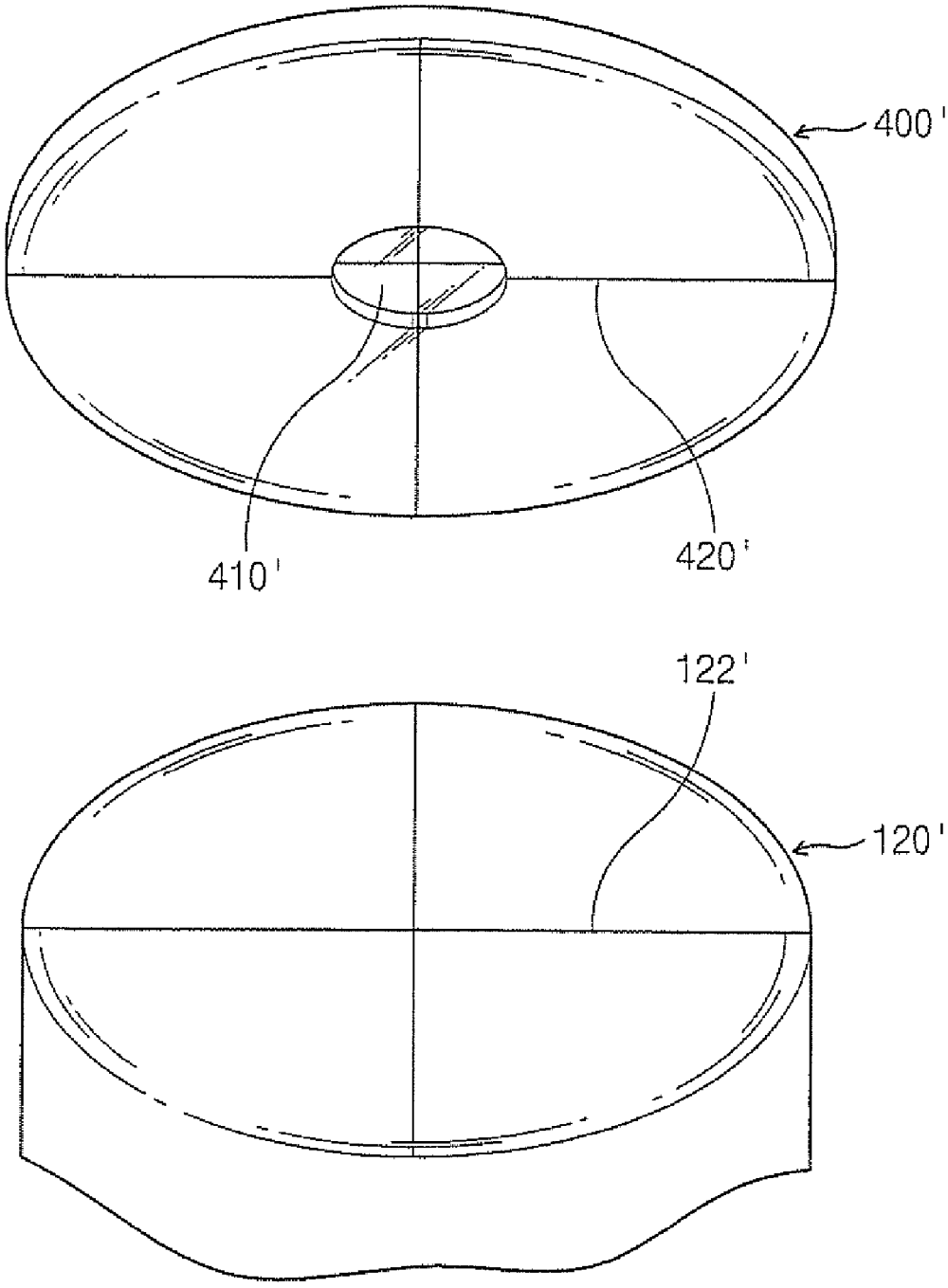
FIG. 16 is a perspective view illustrating a polishing pad and platen with matching registration marks according to some embodiments of the present invention.
Figure 17:
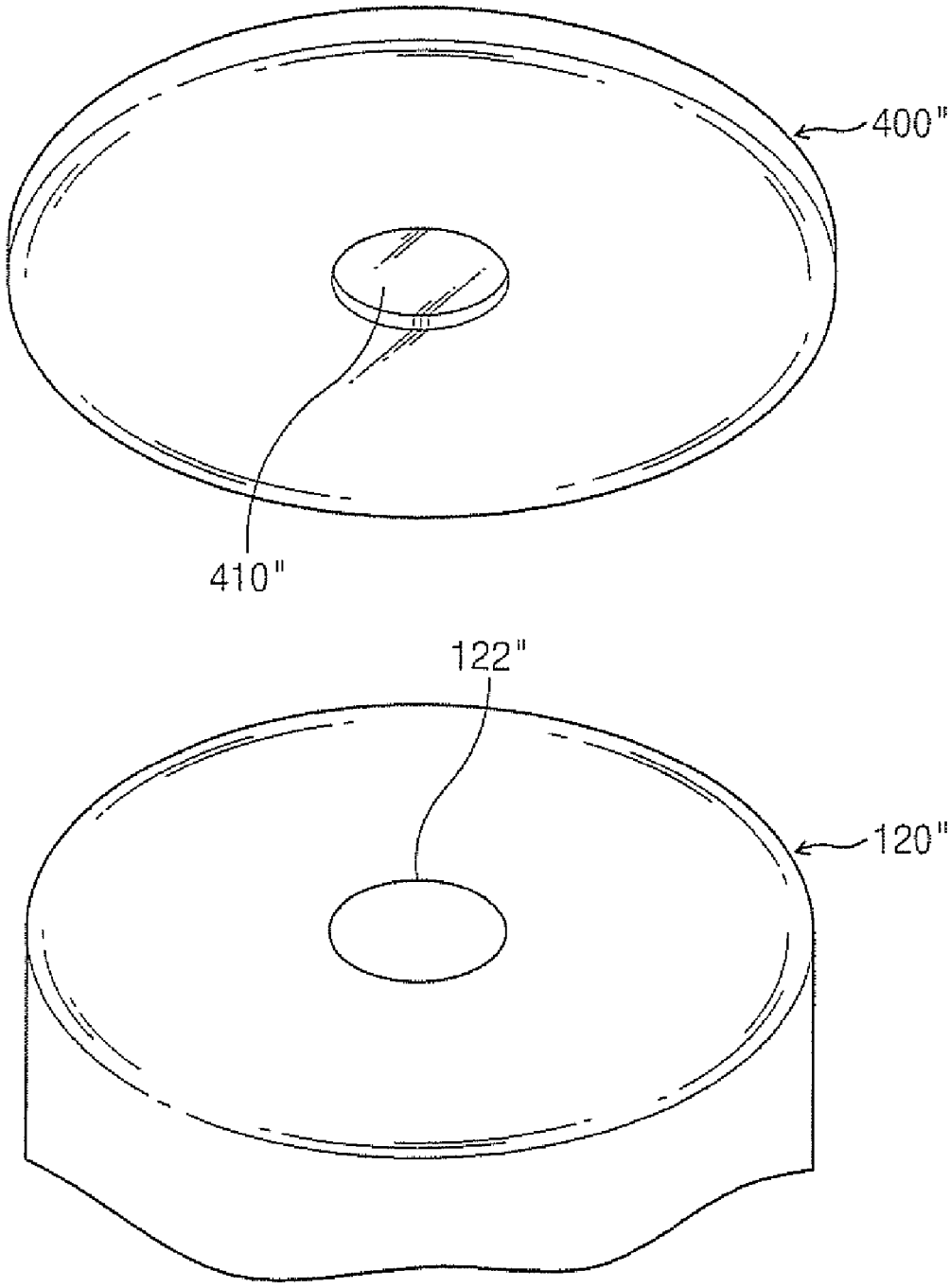
FIG. 17 is a perspective view illustrating a platen with registration marks according to further embodiments of the present invention.

According to further aspects of the present invention, registration features may be provided on a polishing pad and/or platen to facilitate alignment of a recess or other feature that is used to vary the surface rigidity of a polishing pad. For example, as shown in FIG. 16, a platen 120' may have registration lines 122' thereon which are configured to align with corresponding lines 420' on a polishing pad 400' having a recess 410' therein. Alignment of the marks 420', 122' may be facilitated by fabricating the pad 400' out of a transparent material, such that the marks may be viewed through the pad 400'. In this manner, the recess 4lo can be accurately positioned at the center of the platen 120'. As shown in FIG. 17, a circular alignment mark 122' configured to match a recess 410" of a polishing pad 400" may be provided on a platen 120" to provide a similar alignment capability.

Figure 18:
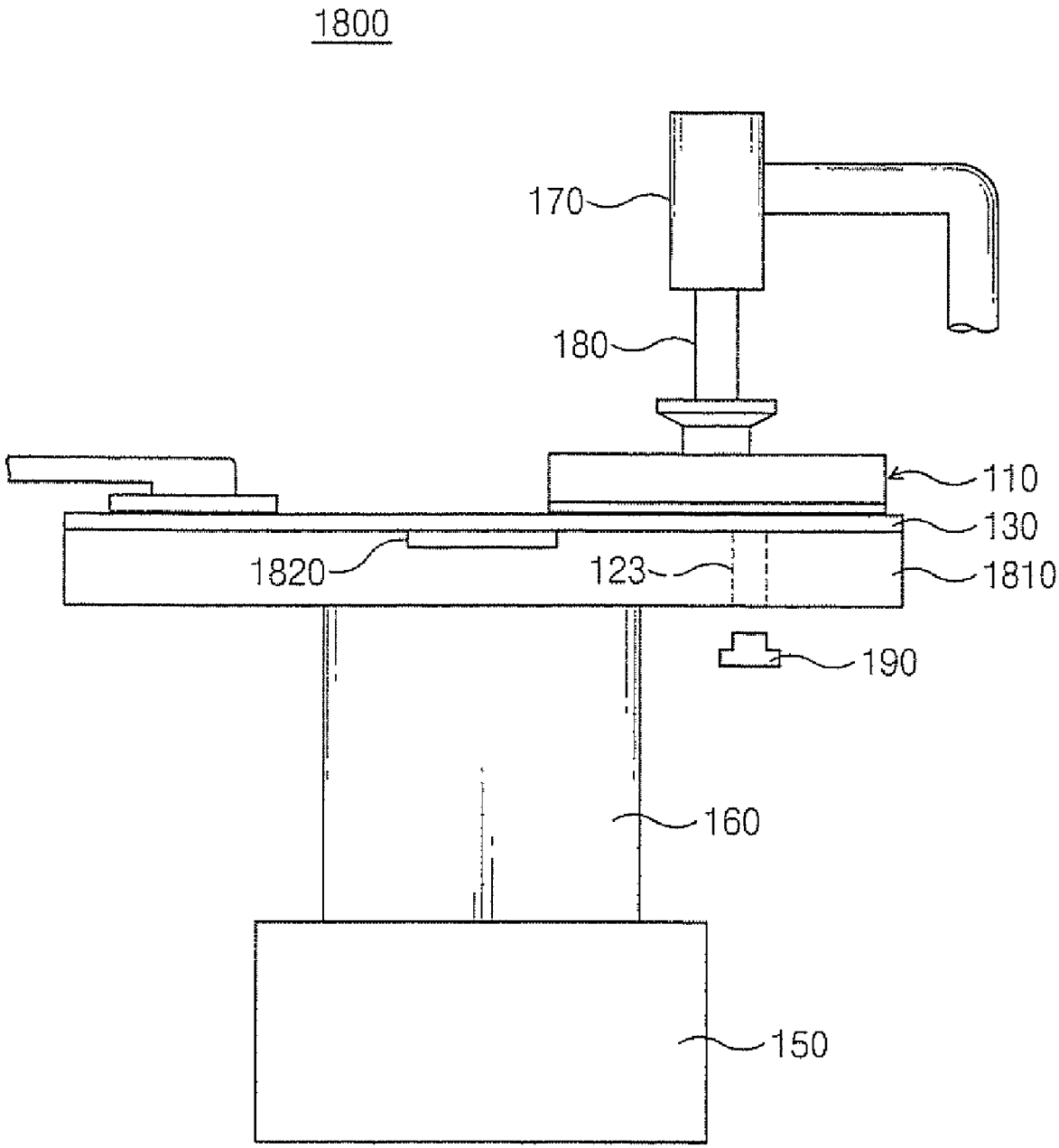
FIG. 18 is a side view of a polishing apparatus according to additional embodiments of the present invention.
Figure 19:
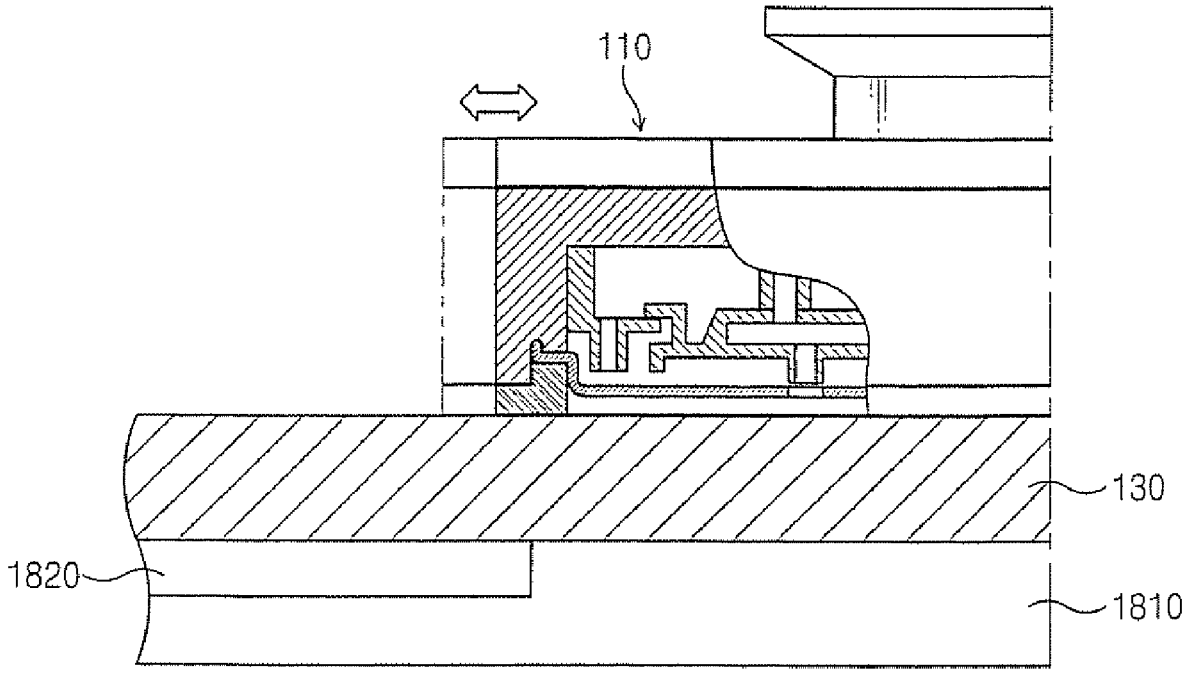
FIG. 19 is a cutaway view illustrating features of the platen of the polishing apparatus of FIG. 18 in relation to the polishing head of the apparatus of FIG. 18.

According to further embodiments of the present invention illustrated in FIG. 18, a polishing apparatus 1800 may achieve improved performance by using a recess 1820 in its platen 1810 to provide a reduced-rigidity area. As shown in FIGS. 18 and 19, the recess 1820 may be positioned similarly to the pad recess 410 shown in FIGS. 11-13. It will be appreciated that, in other embodiments of the present invention, a recess or recesses having other configurations (e.g., grooved) and/or filled with a less rigid material that reduces surface rigidity may be used. It will also be appreciated that, some embodiments of the present invention, recesses and/or other selective cushioning strictures may be provided in both platen and polishing pad. As further shown in FIG. 18, the apparatus 1800 may further include a detector 190 that is operative to monitor a surface of a wafer W through an opening 123 in the platen 120 and through the pad 130, along the lines described above with reference to FIG. 11.

In the drawings and specification, there have been disclosed typical embodiments of the invention and, although specific terms are employed, they are used in a generic and descriptive sense only and not for purposes of limitation, the scope of the invention being set forth in the following claims.

What is claimed is:

1. A chemical mechanical polishing apparatus comprising:

a platen;

a polishing pad affixed to a surface of the platen; and a polishing head configured to retain and rotate a wafer while pressing a surface of the rotating wafer against the polishing pad, wherein the platen and the polishing head interoperate such that the rotating wafer moves in a loop across a surface of the pad, wherein the polishing head comprises a retaining ring that retains an edge of the wafer and that extends flush with the surface of the wafer and wherein a first portion of the polishing pad that engages the retaining ring of the polishing head proximate an innermost portion of the loop provides less rigidity than a second portion of the polishing pad that engages an entire surface of the wafer, wherein the polishing pad and the platen interoperate to provide a cushion where the polishing pad engages the retaining ring of the polishing head, wherein the cushion comprises an airspace bounded by the pad and/or the platen, wherein the airspace comprises a recess in the pad and/or a recess in the platen, wherein the pad comprises:

a first resilient layer having the recess therein; and a second resilient layer interposed between the first resilient layer and the surface of the platen and less rigid than the first resilient layer and wherein the second resilient layer has an opening therethrough between the recess of the first resilient layer and the surface of the platen.

2. An apparatus according to claim 1, further comprising a material less rigid than the first resilient layer in the recess in the first resilient layer and the opening through the second resilient layer.

3. A polishing pad for a chemical mechanical polishing apparatus that includes a platen having a surface configured to receive a polishing pad thereon and a polishing head configured to retain and rotate a wafer while pressing a surface of the rotating wafer against the polishing pad, the polishing head and platen configured to interoperate such that the rotating wafer moves in a loop across a surface of the pad, the polishing head comprising a retaining ring that retains an edge of the wafer and that extends flush with the surface of the wafer, the polishing pad comprising:

a resilient layer configured to be affixed to the surface of the platen and to engage the rotating wafer, wherein the resilient layer, when affixed to the platen, has a first portion that engages the retaining ring of the polishing head proximate an innermost portion of the loop and that provides less rigidity than a second portion of the resilient layer that engages the surface of the wafer, wherein the resilient layer has a recess in a surface thereof positioned toward the surface of the platen and proximate the innermost portion of the loop, wherein the resilient layer comprises a first resilient layer having the recess therein and a second resilient layer configured to be interposed between the first resilient layer and the surface of the platen and less rigid than the first resilient layer, and wherein the second resilient layer has an opening therethrough in communication with the recess in the first resilient layer.

4. A pad according to claim 3, further comprising a material less rigid than the first resilient layer in the recess in the first resilient layer and the opening through the second resilient layer.

* * * * *